United States Patent [19]

Kramer

[11] 4,028,011

[45] June 7, 1977

[54] LOW WELL YIELD CONTROL SYSTEM

[76] Inventor: Richard W. Kramer, R.D. No. 2, Box 490 B, Northumberland, Pa. 17857

[22] Filed: Sept. 3, 1975

[21] Appl. No.: 610,064

Related U.S. Application Data

[63] Continuation of Ser. No. 472,133, May 22, 1974, abandoned.

[52] U.S. Cl. ..... 417/278; 415/11; 417/279; 417/440

[51] Int. Cl.[2] ..... F04B 49/00; F01B 25/00

[58] Field of Search ..... 417/26, 40, 211.5, 278, 417/306, 61, 279, 295, 297.5, 307, 309, 30, 440; 66/54, 68, 105, 112, 315; 415/11, 53 R; 137/386, 429

[56] References Cited

UNITED STATES PATENTS

| | | | |
|---|---|---|---|
| 1,558,640 | 10/1925 | Seaborne | 415/11 |
| 3,726,618 | 4/1973 | Dicmas | 415/11 |

*Primary Examiner*—Carlton R. Croyle
*Assistant Examiner*—G. P. LaPointe
*Attorney, Agent, or Firm*—Thomas Hooker

[57] ABSTRACT

A control system for preventing over-pumping of wells using submersible pumps. When the pump lowers the level of the water in the well, the control automatically diverts some or all of the water pumped back into the well to assure that sufficient water is available in the well for pumping. In this way, pump cavitation is eliminated and water is pumped from the well either at a rate equal to the capacity of the pump or, if the flow of water into the well is less than the capacity of the pump, at a rate equal to the flow of water into the well.

10 Claims, 6 Drawing Figures

LOW WELL YIELD CONTROL SYSTEM

This application is a continuation of my co-pending application Ser. No. 472,133 filed May 22, 1974 now abandoned for "Low Well Yield Control System".

The invention relates to control systems for pumps for wells and particularly to a control system for use with a constant speed submersible well pump. These pumps are conventionally powered by a constant speed electric motor and are hung in the well at the bottom of a riser pipe through which water is pumped up out of the well. Because a submersible pump operates at a constant speed, the well will be over-pumped if the capacity of the pump exceeds the rate of water flowing into the well. In this event, the level of water is drawn down below the inlet to the submersed pump resulting in cavitation which is very harmful to the pump and frequently results in the burning out of the pump.

The invention eliminates this problem and assures that the constant speed pump delivers a flow of water from the well equal either to the capacity of the pump, in the event the rate of flow of water into the well is equal or greater to the capacity of the pump, or equal to the rate of flow of water into the well in the event such rate is less than the capacity of the pump. In this way, the maximum water available for pumping by the pump is removed from the well, despite the operation of the pump at its constant pumping rate, which may be greater than the rate of discharge of water from the well. Cavitation is eliminated. The rate at which water is pumped from the well is automatically adjusted as a function of the rate of water flow into the well, as indicated by the water level in the well.

A number of control devices have been used to protect submersible pumps from over-pumping. One such control device includes a pair of electrodes positioned at different levels in the well. When the level of the water in the well is pumped down below the lower electrode, the pump is automatically turned off by a switch and remains off until the water level rises above the higher electrode. No water is pumped from the well when the pump is off. In practice, impurities in the well water such as iron, calcium, acid or the like, foul the electrodes and render the control system inoperative after a period of operation. This type of control system is additionally unsatisfactory since it shuts down the well entirely during the period when the water level climbs back up to the upper electrode. Maximum available water is not pumped from the well.

A pneumatic control device has been used to stop the pump when the water in the well has been drawn down to a given level. This type of control includes a hollow tube extending down the well. The tube is manually pressurized when the water is at a high level so that when the water level falls below the end of the tube the pressure is released and a pressure switch turns the pump off. The pump must be manually restarted when the level of water in the well has risen.

U.S. Pat. No. 1,507,454 discloses a float controlled valve for an oil well in which the float moves a rod through a lost motion connection so that a check valve is held open to prevent pumping when the oil in the well is drawn down to a low level. The lost motion connection prevents release of the check valve until after the oil has risen to a high level.

Other objects and features of the invention will become apparent as the description proceeds, especially when taken in conjunction with the accompanying drawings illustrating the invention, of which there are two sheets.

IN THE DRAWINGS

Figure 1:
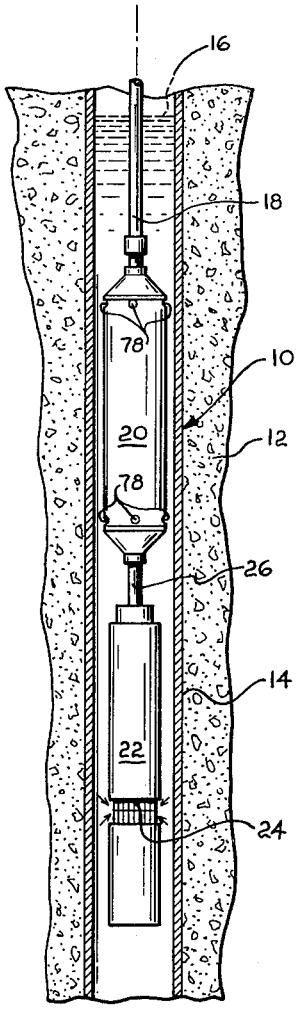
FIG. 1 is a partially broken away view illustrating the low well yield control system in a cased well.

FIG. 1 illustrates a drilled well 10 extending down through normally saturated strata 12 and including a metal cylindrical casing 14. Water flows from the strata into the well to establish a normal water level 16. A riser pipe 18 extends down the interior of casing 14 and supports control system 20 and submersible electric pump 22. An electric power cable (not shown) also extends down the casing to power pump 22. The pump includes an electric motor and a centrifugal pump so that water in the well flows into pump inlet 24 and is pumped up pipe portion 26 located between the pump and the control system and into the system 20. The motor of submersible electric pump 22 operates at a constant speed so that a constant volume of water is pumped up pipe 26, without regard to the flow of water into the well from the surrounding strata. In the event that the capacity of the pump 22 is greater than the flow capacity of the well, the control system 20 divides the output from the pump and diverts a portion of the output of the pump flowing up through pipe 26 back into the well so that the total of the water flow into the well from the surrounding strata plus the diverted portion of the water pumped through pipe portion 26 equals the capacity of the pump. The remaining portion of the water flowing up pipe 26, that is the amount of water flowing into the well from the strata, is pumped up riser pipe 16 for surface use. In the event that the flow into the well equals or exceeds the capacity of the pump, full pump capacity is pumped to the surface. If no water flows into the well, all the pumped water is diverted back into the well and no water is pumped from the well.

Figure 2:
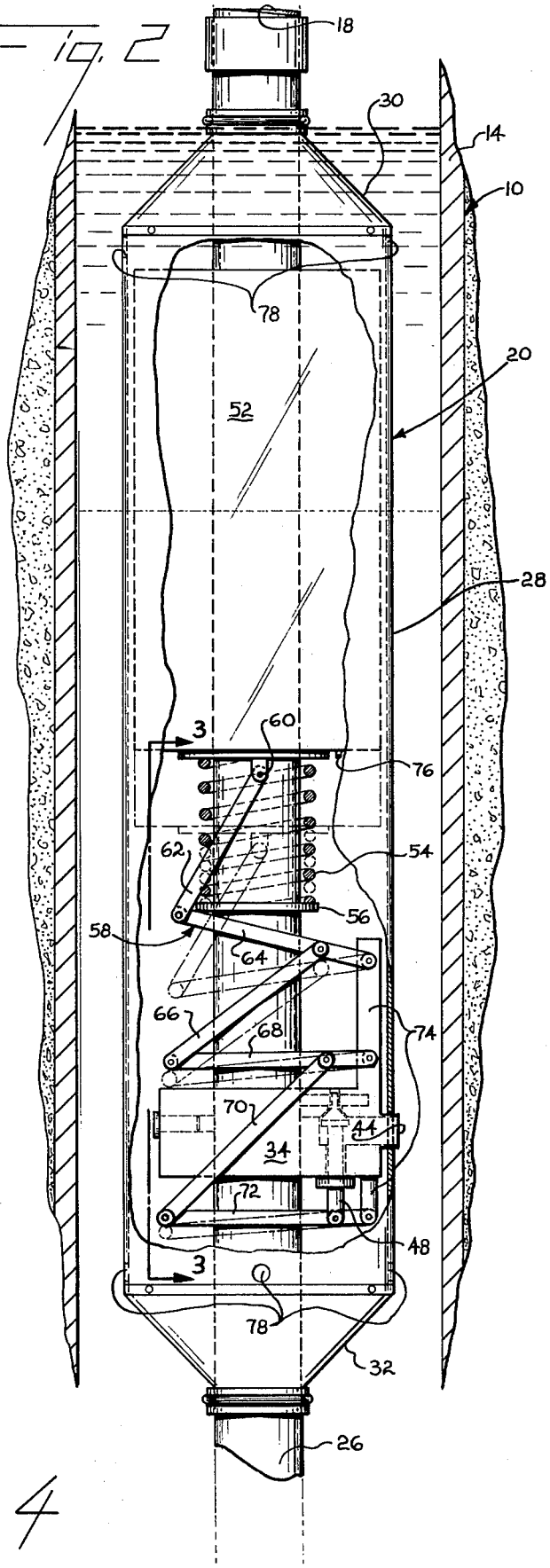
FIG. 2 is an enlarged and further broken away view of the control system shown in FIG. 1.
Figure 4:
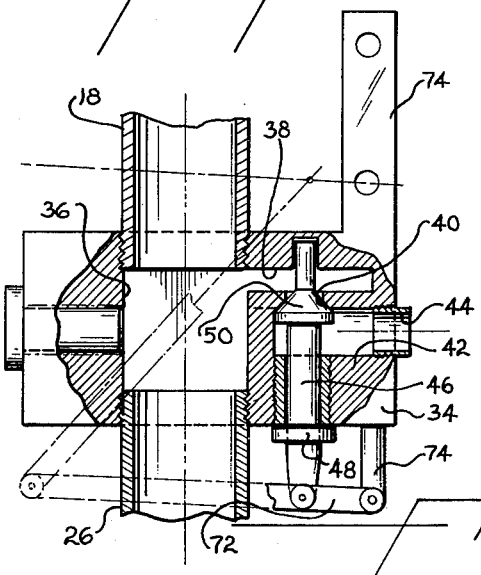
FIG. 4 is an enlarged broken away view of the valving mechanism shown in FIG. 2.

As illustrated in FIG. 2, the control system 20 fits concentrically within casing 14. The control system includes a cylindrical casing 28 which surrounds the lower end of the riser pipe and the upper end of pipe 26. The pipe 26 extends from pump 22 past the lower body end 32 to valve body 34 and is secured to body 34 as illustrated in FIG. 4. The lower end of riser pipe 18 extends past housing end 30 through the major portion of cylindrical body 28 and is secured to the upper side of valve body 34 as shown in FIG. 4. Pipes 18 and 26 communicate with each other in valve body 34 so that all the water pumped up through pipe 26 is free to flow up through pipe 18, depending upon the position of the valve. Passage 36 in valve body 34 connects pipes 18 and 26. Passage 38 is provided in body 34 and extends to one side of passage 36. Valve seat 40 is positioned between passage 38 and exhaust passage 42 which extends through the cylindrical casing 28 to an exhaust opening 44 within the well casing 10.

Valve stem 46 extends from the bottom of body 34 through bushing 48, passage 42, and past the valve seat 40. The stem carries a conical valving member 50 which is engagable with seat 40 when the stem is in the position shown in FIG. 4 to prevent flow from passage 38 to the exhaust passage 42.

A closed hollow annular float 52 is confined within casing 28 and surrounds the riser pipe 18 above body 34. Float spring 54 surrounds the riser pipe and is confined between a washer 56 on the pipe above the body 34 and the float 52. The spring biases the float toward the upper end 30 of casing 28. A mechanical linkage 58 connects bracket 60 on the bottom of the float to the valve stem 46 so that the valve between passages 38 and 42 is opened or closed depending upon the vertical position of the float in the casing 28.

Figure 3:
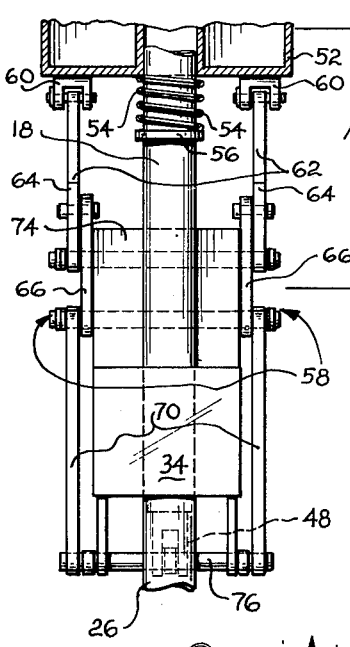
FIG. 3 is a view taken generally along line 3—3 of FIG. 2.

The linkage 68, as illustrated in FIGS. 2 and 3, includes a pair of like linkages located to either side of the valve body 34. Each of these linkages includes a number of link members 62, 64, 66, 68, 70, and 72. One end of each of the link members 64, 68, and 62 is pivotally connected to supports 74 on the valve body 34. Link member 62 is pivotally connected between bracket 60 and the other end of link member 64. Link members 66 and 68 are similarly pivotally connected between link member 64 adjacent support 74 and the support. Link members 70 and 72 are similarly connected between link member 78 adjacent support 74 and the support. A rod 76 extends between the two link members 72 adjacent the lower support 74 and is connected to the end of valve stem 68 so that as the link members 72 rotate with respect to the lower support 74, the stem is moved vertically to open or close the valve between passages 38 and 42. A number of vent ports 78 are provided in both ends of casing 28 so that the casing is filled with water up to the level 16 of water in the well.

In FIG. 2, float 52 is shown completely submerged in the water in the well casing 10 and accordingly, the hydrostatic pressure exerted on the float, together with the force of spring 54 have raised the float to the upper most position in casing 28. The linkage 58 is expanded and the valve 68 is raised so that the valve member 50 engages valve seat 40 to close the opening between passages 38 and 42. When the water level in the well is above the casing, the exhaust passage is closed and the entire output of pump 22 is pumped up the riser pipe 18 to the surface.

The buoyancy of the float, together with the upward bias of spring 54 exert an upward force on brackets 60. This force is multiplied by the linkage 58 so that when the float is in the uppermost position as shown in FIG. 2 with the water level in the well above the float, the valving member 50 is held firmly against seat 40 and prevents the pressurized water being pumped through chamber 36 from opening the valve. The float 52 may be pressurized through an air valve 76 in order to prevent collapse due to the hydrostatic pressures encountered in deep wells where the water level is at times located many feet above the control system and pump. The float would be pressurized prior to installation in the well.

Submersible electric pumps run at a constant speed and pump water at a constant rate. So long as this rate is less than the rate of flow of water into the well, the water level in the well will be maintained. When the rate of flow of water into the well falls below the pumping rate of pump 22, the water level in the well will be drawn down and as the level lowers, the hydrostatic force exerted on float 52 will decrease and the float will lower and the mechanical linkage 58 will collapse moving the valve member 50 away from the valve seat 40 to begin to open the valve between passages 38 and 42. When this occurs, some of the water being pumped up through pipe 26 to chamber 36 will be discharged from the valve body 34 through passages 38 and 42 and will flow through exhaust 44 to replenish the water in the well. The float will continue to fall and valve between passages 38 and 42 will continue to open until the amount of water flowing through exhaust 44, together with the flow into the well, equals the pumping capacity of pump 22. The portion of the water pumped up through pipe 26 which is not diverted back into the well flows up pipe 18 to the surface for use there. This flow equals the flow of water into the well. Differences in the flow rate into the well are automatically compensated for by upward or downward movement of the float and corresponding closing or opening of the valve between passages 38 and 42. The control system 20 automatically replenishes the water in the well with a sufficient quantity of water being pumped by pump 22 to supplement the flow into the well and provide sufficient water for pumping at the rate of the submersible pump. In this way, the water level in the well is never pumped down below the pump inlet 22 and damaging cavitation is eliminated. All of the water flowing into the well is pumped from the well up to a flow rate equal to the capacity of the pump. No water is pumped up pipe 18 only when there is no flow into the well. In this event, the pump recirculates the water in the well.

Figure 5:
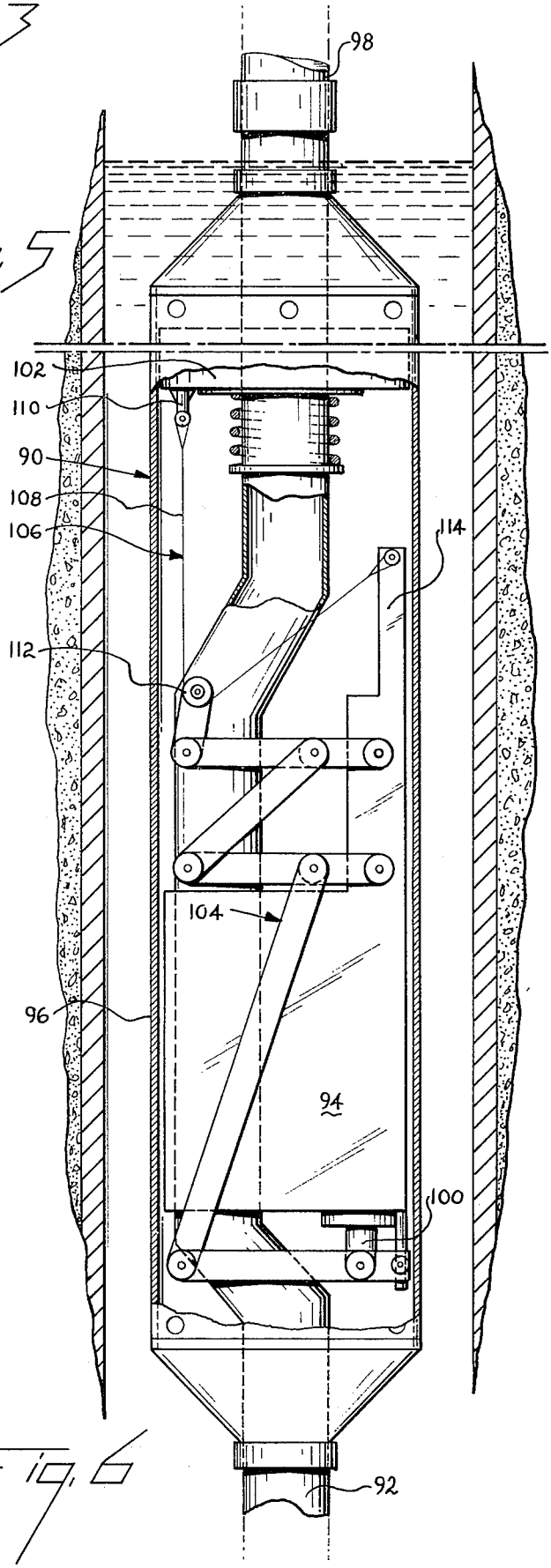
FIGS. 5 and 6 are similar to FIG. 2 illustrating other embodiments of the invention.

FIG. 5 illustrates a modified low well yield control system 90 in which the upper end of the connecting pipe 92 extending from the submersible pump is connected to valve body 94 adjacent one side of the cylindrical casing 96. The lower end of riser pipe 98 joins the valve body 94 at the same side of the casing 96. The exhaust passages and valve operated by movement of stem 100 are located in the body between the ends of the two pipes 92 and 98 and the opposite side of the casing 96. The end of valve stem 100 is connected to a hollow annular float 102 by a mechanical linkage 104, similar to mechanical linkage 58 in control system 20, and a pulley and cable connection 106. One end of cable 108 is connected to a bracket 110 on the bottom of float 102, and the cable extends from the bracket through a pulley 112 connected to the end of the uppermost link of linkage 104 and is fixed to support 114 on the valve body 94. The connection between the float and the valve stem moves the valve stem up and down in response to movement of the float as in the embodiment of FIG. 2 so that if the flow rate for the well falls below the pumping rate for the submersible electric pump, and the level of water in the casing falls sufficiently to lower the float, the valve in valve body 94 is opened to permit a sufficient portion of the water flowing through pipe 94 to replenish the water in the well, thereby assuring a supply of water to be pumped sufficient to prevent pumping the well dry or cavitation in the pump.

The specific arrangement of the ends of pipes 92 and 98 to one side of the housing 96 and the use of a cable and pulley linkage in the connection between the float and the valve stem results in a control system somewhat less bulky than that illustrated in FIG. 2. This embodiment is particularly adaptable for use in smaller diameter wells where the larger system would not fit within the casing.

Figure 6:
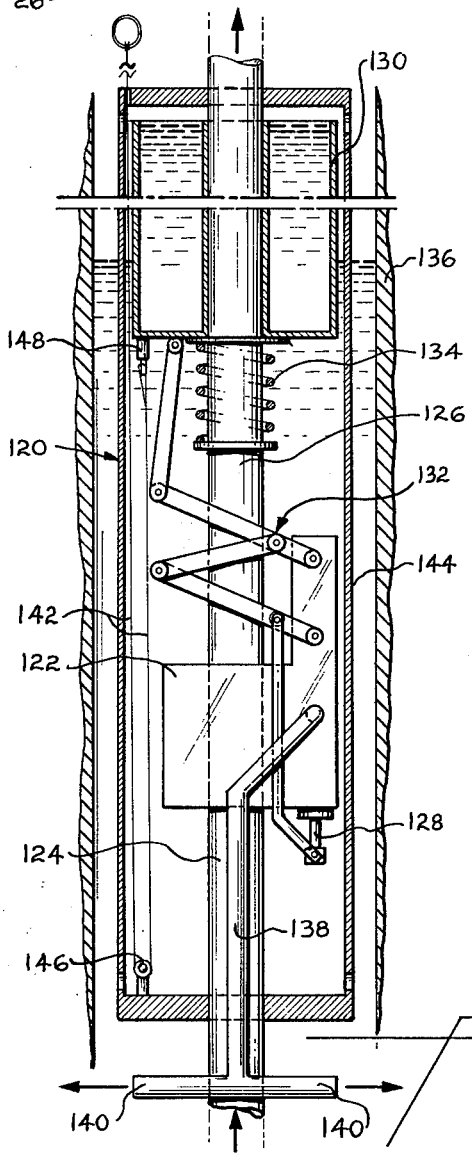

The control system 120 illustrated in FIG. 6 of the drawings, includes a valve body 122 similar to the bodies 34 and 94 shown in FIGS. 2 and 5. The valve body is located between the ends of connecting pipe 124 and riser pipe 126 and includes a valve opened and closed by movement of valve stem 128. The stem is connected to a traveling hydrostatic cylinder 130 by means of a mechanical linkage 132 similar to the linkage 58 shown in FIGS. 2 and 3. Cylinder 130 surrounds the riser pipe 126 and is open on the top so that when the level of water in the well casing 132 is above the control system 120, the interior of the cylinder is filled with water. If the level of water in the well is drawn down below the top of the cylinder, the force exerted on the spring 134 is increased and the cylinder is lowered to collapse linkage 132 and open the valve in body 122, thereby replenishing the water in the well to the extent required by the pump. The water replenishing the well flows from the valve body 122 through exhaust pipe 138 to a pair of exhaust outlets 140 aimed to direct the flow against the walls of the well casing 136.

In some cases, the interior surface of the well casing becomes clogged and prevents water in the surrounding strata from flowing into the well. The control system 120 is provided with a cable 142 which extends from the top of the well down the well casing and into the casing 144 to a pulley 146 fixed on the lower end of the casing and then back up through the casing to an attachment 148 on the bottom of the hydrostatic cylinder. The end of the cable 142 at the surface may be pulled to lower the hydrostatic cylinder, thereby opening the valve in body 122 and directing streams of water against the interior surface of the casing to improve water flow into the well. When the cable is released, the hydrostatic cylinder resumes its normal position and the control system 120 operates in the manner as previously described. The cable pull down and the outwardly directed exhaust outlets as shown in FIG. 6 may be used in the other embodiments of the low well yield control system as shown in FIGS. 2 and 6.

The low well control systems illustrated and described herein are intended for use in conjunction with submersible electric well pumps where the electric motor and pump driven by the motor are submerged in the well. The full output of the pump flows through the valve body and is proportioned between the exhaust and the riser pipe as a function of the rate at which water flows into the well. The low well yield control systems could also be used in wells having a submerged pump driven by a remote power source through a drive connection, such as a rotating or reciprocating shaft. In this event, all of the water pumped from the well would flow through the valve body and would be appropriately divided between the riser pipe and the replenishing exhaust so that sufficient water was always available in the well to meet the capacity of the pump.

The control system has been illustrated and described as used in a water well. The invention is not limited to such use but, is suitable for controlling pumping of liquids from sources such as reservoirs, tanks, and the like where the rate of flow of the liquid into the source varies and may fall below the capacity of the pump.

While I have illustrated and described preferred embodiments of my invention, it is understood that these are capable of modification, and I therefore do not wish to be limited to the precise details set forth, but desire to avail myself of such changes and alterations as fall within the purview of the following claims.

What I claim as my invention is:

1. A control system for preventing overpumping liquid from a reservoir of liquid by a pump having an inlet located in the liquid and a pipe extending from the pump for removing liquid from the reservoir, the control system comprising a member defining a passage communicating the interior of the pipe with the reservoir, a valve in the passage operable to open and close the passage, a body vertically moveable in response to change in the level of the liquid in the reservoir operatively connected to the valve to actuate the same for progressively opening and closing the passage and a spring biasing said body vertically upwardly so that the passage is opened sufficiently to permit an amount of liquid pumped from the reservoir and into the pipe to flow through the passage and back into the reservoir to replenish the liquid supply in the reservoir sufficiently to meet the capacity of the pump.

2. A control system for preventing overpumping liquid from a reservoir of liquid by a pump having an inlet located in the liquid in the reservoir and a pipe extending from the pump for removing liquid from the reservoir, the control system comprising a member defining a passage communicating the interior of the pipe with the reservoir, a valve in the passage operable to open and close the passage, a float surrounding the pipe and vertically movable in response to change in the level of the liquid in the reservoir, and an operative connection between the float and said valve to actuate the same for progressively opening and closing the passage in response to decrease and increase respectively of the rate at which liquid flows into the reservoir when such rate is less than the rate at which the pump removes liquid from the reservoir so that the passage is opened sufficiently to permit an amount of liquid pumped from the reservoir and into the pipe to flow through the passage and back into the reservoir to replenish the liquid supply in the reservoir sufficiently to meet the capacity of the pump.

3. A control system for preventing overpumping liquid from a reservoir of liquid by a pump having an inlet located in the liquid in the reservoir and a pipe extending from the pump for removing liquid from the reservoir, the control system comprising a member defining a passage communicating the interior of the pipe with the reservoir, the end of the passage outwardly of the pipe being directed at a wall of the reservoir, a valve in the passage operable to open and close the passage, a body vertically movable in response to change in the level of the liquid in the reservoir, and an operative connection between the body and said valve to actuate the same for progressively opening and closing the passage in response to decrease and increase respectively of the rate at which liquid flows into the reservoir when such rate is less than the rate at which the pump removes liquid from the reservoir so that the passage is opened sufficiently to permit an amount of liquid pumped from the reservoir and into the pipe to flow through the passage and back into the reservoir to replenish the liquid supply in the reservoir sufficiently to meet the capacity of the pump.

4. A control system as in claim 3 wherein the body comprises a float and including means for lowering the float below its normal level in the reservoir to open the valve.

5. A control system for preventing overpumping liquid from a reservoir of liquid by a pump having an inlet located in the liquid in the reservoir and a pipe extending from the pump for removing liquid from the reservoir, the control system comprising a member defining a passage communicating the interior of the pipe with the reservoir, a valve in the passage operable to open and close the passage, a float vertically movable in response to change in the level of the liquid in the reservoir, and an operative connection between the float and said valve to actuate the same for progressively opening and closing the passage in response to decrease and increase respectively of the rate at which liquid flows into the reservoir when such rate is less than the rate at which the pump removes liquid from the reservoir so that the passage is opened sufficiently to permit an amount of liquid pumped from the reservoir and into the pipe to flow through the passage and back into the reservoir to replenish the liquid supply in the reservoir sufficiently to meet the capacity of the pump, a casing secured to the pipe and surrounding said valve, float and connection, and an opening extending through said casing at the top thereof and an opening extending through the casing at the bottom thereof to permit liquid in the reservoir to flow into and out of the casing.

6. A pumping system for pumping liquid from a deep well, the system being of the type having a constant speed centrifugal pump submerged in the liquid at the lower end of the well, the pump having an inlet located a distance below the level of liquid in the well at all times; a riser pipe in the well extending upwardly from the pump to the surface; wherein the improvement comprises a control located between the pump and the riser pipe; the control having an upwardly extending conduit joined at the lower end thereof to the output passage of the pump and at the upper end thereof to the lower end of the riser pipe, a valve body on the conduit, a discharge passage extending through the valve body from the interior of the conduit to the interior of the well to provide liquid flow communication therebetween when the passage is open, a valve in the passage operable to open or close the passage progressively and thereby progressively permit or prevent the flow of pumped liquid through the passage and back into the well, a hydrostatic pressure responsive member located above the pump inlet and attached to the control to permit vertical upward and downward movement thereof in response to raising and lowering of the level of the liquid in the well, the level of the liquid when the member is at the lowermost position being above the inlet of the pump to prevent pumping of air; spring means biasing said hydrostatic pressure responsive member upwardly; and a linkage joining the member and the valve such that when the liquid level is high and the member is raised the valve is closed to prevent liquid flowing through the passage and back into the well and when the member lowers in response to lowering of liquid level in the well the valve is progressively opened to permit an increasing flow of liquid through the passage and into the well to resupply the liquid in the well available for pumping and thereby prevent overpumping of the well.

7. A pumping system for pumping liquid from a deep well, the system being of the type having a constant speed centrifugal pump submerged in the liquid at the lower end of the well, the pump having an inlet located a distance below the level of liquid in the well at all times; a riser pipe in the well extending upwardly from the pump to the surface; wherein the improvement comprises a control located between the pump and the riser pipe; the control having an upwardly extending conduit joined at the lower end thereof to the output passage of the pump and at the upper end thereof to the lower end of the riser pipe, a valve body on the conduit, a discharge passage extending through the valve body from the interior of the conduit to the interior of the well to provide liquid flow communication therebetween when the passage is open, said discharge opening being directed at a wall of the well, a valve in the passage operable to open or close the passage progressively and thereby progressively permit or prevent the flow of pumped liquid through the passage and back into the well, a hydrostatic pressure responsive member located above the pump inlet and attached to the control to permit vertical upward and downward movement thereof in response to raising and lowering of the level of the liquid in the well, the level of the liquid when the member is at the lowermost position being above the inlet of the pump to prevent pumping of air; and a linkage joining the member and the valve such that when the liquid level is high and the member is raised the valve is closed to prevent liquid flowing through the passage and back into the well and when the member lowers in response to lowering of liquid level in the well the valve is progressively opened to permit an increasing flow of liquid through the passage and into the well to resupply the liquid in the well available for pumping and thereby prevent overpumping of the well.

8. A pumping system as in claim 7 wherein the hydrostatic pressure responsive member comprises a float and including means for lowering the float below its normal level in the well to open the valve.

9. A pumping system for pumping liquid from a deep well, the system being of the type having a constant speed centrifugal pump submerged in the liquid at the lower end of the well, the pump having an inlet located a distance below the level of liquid in the well at all times; a riser pipe in the well extending upwardly from the pump to the surface; wherein the improvement comprises a control located between the pump and the riser pipe; the control having an upwardly extending conduit joined at the lower end thereof to the output passage of the pump and at the upper end thereof to the lower end of the riser pipe, a valve body on the conduit, a discharge passage extending through the valve body from the interior of the conduit to the interior of the well to provide liquid flow communication therebetween when the passage is open, a valve in the passage operable to open or close the passage progressively and thereby progressively permit or prevent the flow of pumped liquid through the passage and back into the well, a hydrostatic pressure responsive member located above the pump inlet, said member surrounding the riser pipe and being attached to the control to permit vertical upward and downward movement thereof in response to raising and lowering of the level of the liquid in the well, the level of the liquid when the member is at the lowermost position being above the inlet of the pump to prevent pumping of air; and a linkage joining the member and the valve such that when the liquid level is high and the member is raised the valve is closed to prevent liquid flowing through the passage and back into the well and when the member lowers in response to lowering of liquid level in the well the valve is progressively opened to permit an increasing flow of liquid through the passage and into the well to resupply the liquid in the well available for pumping and thereby prevent overpumping of the well.

10. A pumping system for pumping liquid from a deep well, the system being of the type having a constant speed centrifugal pump submerged in the liquid at the lower end of the well, the pump having an inlet located a distance below the level of liquid in the well at all times; a riser pipe in the well extending upwardly from the pump to the surface; wherein the improvement comprises a control located between the pump and the riser pipe; the control having an upwardly extending conduit joined at the lower end thereof to the output passage of the pump and at the upper end thereof to the lower end of the riser pipe, a valve body on the conduit, a discharge passage extending through the valve body from the interior of the conduit to the interior of the well to provide liquid flow communication therebetween when the passage is open, a valve in the passage operable to open or close the passage progressively and thereby progressively permit or prevent the flow of pumped liquid through the passage and back into the well, a hydrostatic pressure responsive member located above the pump inlet and attached to the control to permit vertical upward and downward movement thereof in response to raising and lowering of the level of the liquid in the well, the level of the liquid when the member is at the lowermost position being above the inlet of the pump to prevent pumping of air; a linkage joining the member and the valve; and a casing surrounding the control with an opening extending through said casing at the top thereof and an opening extending through the casing at the bottom thereof to permit liquid in the well to flow into and out of the casing such that when the liquid level is high and the member is raised the valve is closed to prevent liquid flowing through the passage and back into the well and when the member lowers in response to lowering of liquid level in the well the valve is progressively opened to permit an increasing flow of liquid through the passage and into the well to resupply the liquid in the well available for pumping and thereby prevent overpumping of the well.

* * * * *